US006558565B1

(12) United States Patent
Matsutani et al.

(10) Patent No.: US 6,558,565 B1
(45) Date of Patent: May 6, 2003

(54) COMPOSITE MAGNETIC MATERIAL

(75) Inventors: Nobuya Matsutani, Osaka (JP); Yuji Mido, Osaka (JP); Hiroshi Fujii, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/647,708

(22) PCT Filed: Jan. 31, 2000

(86) PCT No.: PCT/JP00/00497

§ 371 (c)(1),
(2), (4) Date: Nov. 20, 2000

(87) PCT Pub. No.: WO00/48211

PCT Pub. Date: Aug. 17, 2000

(30) Foreign Application Priority Data

Feb. 10, 1999 (JP) ..... 11-032402
Nov. 11, 1999 (JP) ..... 11-320532

(51) Int. Cl.[7] ..... H01F 1/26
(52) U.S. Cl. ..... 252/62.55; 252/62.54; 148/104
(58) Field of Search ..... 252/62.55, 62.54; 148/104

(56) References Cited

U.S. PATENT DOCUMENTS 4,601,765 A * 7/1986 Soileau et al. ..... 148/104
4,696,725 A * 9/1987 Ochiai et al. ..... 252/62.54
6,063,209 A * 5/2000 Matsutani et al. ..... 148/300
6,149,704 A * 11/2000 Moro et al. ..... 252/62.53
6,284,060 B1 * 9/2001 Matsutani et al. ..... 148/300

FOREIGN PATENT DOCUMENTS

JP 2-31403 2/1990
JP 7-254522 10/1995

OTHER PUBLICATIONS

Translation of JP 7–254,522.*

* cited by examiner

*Primary Examiner*—C. Melissa Koslow
(74) *Attorney, Agent, or Firm*—McDermott, Will & Emery

(57) ABSTRACT

A composite magnetic body used for a choke coil, etc. is formed by compression molding of a mixture of magnetic alloy powder containing iron (Fe) and nickel (Ni) as the main component, an insulating material and a binder of an acrylic resin. In the composite magnetic body, high packing rate of the magnetic alloy powder and good insulation between the powder particles stand together, exhibiting a low core loss and a high magnetic permeability. The composite magnetic body can be formed in various core pieces of complex shapes.

32 Claims, No Drawings

COMPOSITE MAGNETIC MATERIAL

TECHNICAL FIELD

The present invention relates to a magnetic body of metallic composite material of high performance level for use in choke coils and the like devices; more specifically, a composite magnetic body for use as a soft magnetic material of a magnetic core.

BACKGROUND ART

In line with the prevailing trend of down-sizing among the recent electric and electronic equipment, demand for a smaller but efficient magnetic body is increasing. For example, in many of the choke coils at high frequency circuit, a ferrite magnetic core formed of a soft magnetic ferrite and a dust core compression-formed of soft magnetic metal powder are used.

Of them, the ferrite magnetic core is noted for its defect of a small saturation magnetic flux density. In order to suppress the decline of the inductance L value and assure the direct-current superposing characteristic, a gap of several hundred microns is provided in a direction vertical to the magnetic path. Such a wide gap, however, may be a source of beat sound, or when used in a high frequency band, in particular, the leakage flux generated in the gap may extremely increase the copper loss in the winding.

By contrast, the dust core fabricated by forming the magnetic metal powder has an extremely large saturation magnetic flux density as compared with the soft magnetic ferrite, therefore it is advantageous in reducing the size of a core down. Also, generation of the beat sound and the copper loss caused by leakage magnetic flux are small, since it can be used without providing the gap.

However, in terms of the magnetic permeability and the electric power loss, dust core is not superior to the ferrite core. When a dust core is used in a choke coil or an inductor, it results in a greater temperature rise corresponding to the greater core loss; so it is hard to make the core size smaller. In order to improve the magnetic characteristics, the dust cores are usually formed by applying a compression force higher than 5 tons/cm$^2$ or even more than 10 tons/cm$^2$, depending on the kind of application. Therefore, it is quite difficult to form a dust core in a compact and complicated core shape; for example, a core for a low profile choke coil for use in a computer DC-DC converter. Thus, there is a greater limitation in the shape of the dust cores, as compared with the case of the ferrite cores. Down-sizing is not easy with the dust cores.

The core loss with the dust cores normally consists of hysteresis loss and eddy current loss. The eddy current loss increases in proportion to the square of frequency and the square of a flowing size of eddy current. Therefore, to suppress the generation of eddy current, surface of the magnetic powder is covered with an electric insulating resin or the like material.

Since the dust cores are formed with a high compression force, the magnetic permeability is deteriorated by the distortion caused in the magnetic body, which brings about a hysteresis loss. To avoid this to happen, a high temperature heat treatment is applied on the compression-formed pieces for relieving from the distortion. In such a case, the use of an insulating binder is essential to ensure a good insulation between the magnetic powder particles while keeping good mutual adhesion.

A conventional magnetic dust core is disclosed in Japanese Laid-open Patent No. 1-215902, which core is formed of a mixture of a magnetic alloy powder, Fe—Al—Si alloy (sendust) or Fe—Ni alloy (permalloy), and an alumina cement powder, which mixture is compression-molded after annealing at 700–1200° C. Japanese Laid-open Patent No. 6-342714 teaches a magnetic dust core which is formed of a mixture of an Fe—Al—Si alloy magnetic powder and a silicone resin, which mixture is compression-molded and then annealed in non-oxidizing atmosphere of 700–1200° C. Further, Japanese Laid-open Patent No. 8-45724 discloses a magnetic dust core that is formed of a mixture of an Fe—P alloy magnetic powder, a silicone resin and an organic titanium, which mixture is compression-molded and then annealed in 700–1200° C. atmosphere.

With the ferrite core having a gap, the inductance L value declines suddenly from a certain point in the direct-current superposing current. In the dust core, by contrast, it declines smoothly along with the direct-current superposing current, but the core can comply with a large current because of the high saturation magnetic flux density. For implementing a high magnetic permeability with the dust core, it is effective to increase the packing rate of alloy powder in a core piece and to reduce the distance between the powder particles.

However, increasing the packing rate contradicts to securing the insulation between the particles; as a result, it is difficult to realize the both requirements at a same time, the high packing rate and the insulation between the powder particles. Furthermore, it is difficult for a dust core to take a complicated shape, which means that there is a substantial restriction in the core shapes available.

DISCLOSURE OF THE INVENTION

The present invention addresses the above described problems existed in the conventional magnetic cores, and it is an objective to offer a composite magnetic body that satisfies both of the requirements at the same time, the high magnetic permeability and the small core loss. Furthermore, the composite magnetic body of the present invention can be formed into a core piece whose shape is of high complexity.

One mode of a composite magnetic body in accordance with the present invention is that which is formed of a mixture of a magnetic alloy powder containing iron (Fe) and nickel (Ni) as the main components and a silicone resin binder for binding the powder particles together, and the mixture is compression-molded. The alloy powder containing iron and nickel as the main components exhibits a high magnetic flux density, and admits a substantial plastic deformation during compression-molding process attaining a high packing rate of the powder in the compressed compact; thus it provides a high magnetic permeability. By combining the magnetic powder with a silicone resin working as a binder, insulation between the alloy powder particles after the compression molding is secured, and the eddy current loss is reduced; hence, a low core loss is realized.

Another mode of a composite magnetic body in accordance with the present invention is that which is formed of a mixture of a magnetic alloy powder containing iron and nickel as the main components, an insulating material and an acrylic resin binder for binding these together, and the mixture is compression-molded. The composite magnetic body in the present mode exhibits, like the magnetic body in the earlier described mode, a high magnetic permeability, and the insulating material assures good insulation between the alloy powder particles after the compression molding to a decreased eddy current loss; hence, a low core loss. The acrylic resin provided as a binder improves the compactibility, which contributes to the formation of a core having a high complexity shape Still other mode of a composite magnetic body in accordance with the present invention is that which is formed of a mixture of an iron powder, or a magnetic alloy powder containing silicon of not more than 7.5% by weight (not including 0%) and iron for the rest, an insulating material and an acrylic resin binder for binding these together, and the mixture is compression-molded. Also in the present mode, the magnetic body exhibits both a high magnetic permeability and a low core loss, and the acrylic resin used as a binder improves the compactibility, which contributes to the formation of a core having a high complexity shape.

BEST MODE FOR CARRYING OUT THE PRESENT INVENTION

Embodiment 1

First, Fe—Ni alloy powder of 45% by weight of Ni and the remainder of Fe was prepared as the magnetic powder by atomizing method. Mean particle diameter of the powder is 50 $\mu$m. Next, a silicone resin (a methyl system silicone resin, having a remainder of approximately 70–80% by weight after heating), a PVB (polyvinyl butyl resin) and water glass were prepared as a binder. Also a silane monomer was prepared as a thermal diffusion inhibitor, and a stearic acid as a fatty acid. These materials were used for making the samples number 1 through 13 of Table 1.

Those samples containing the thermal diffusion inhibitor were provided in the following manner: To 100 parts by weight of the magnetic powder, 0.5 parts by weight of the thermal diffusion inhibitor and 3 parts by weight of ethanol as solvent are mixed by using a mixing agitator. The mixture is dried for 1 hour at 150° C.; and then mixed with 1 part by weight of one of respective binders of Table 1, further 3 parts by weight of xylene as solvent to be mixed again by a mixing agitator. After the mixing is finished, it is dried to remove the solvent. The dried mixture is crushed, and granulated so that it flows smoothly into a mold. Those samples containing the fatty acid are made with the granulated powder by adding 0.1 part by weight of fatty acid and mixing these together by across rotary mixer.

Those samples without having the thermal diffusion inhibitor were provided in the following manner: To 100 parts by weight of the magnetic powder, 1 part by weight of one of the respective binders and 3 parts by weight of xylene as solvent are added to be mixed together by a mixing agitator. After the mixing is finished, it is dried to remove the solvent. The dried mixture is crushed, and granulated so that it flows smoothly into a mold. Those samples containing the fatty acid are made with the above granulated powder by adding 0.1 part by weight of fatty acid and mixing these together by a cross rotary mixer.

TABLE 1

| | Sample No. | Binder | Thermal diffusion inhibitor | Fatty acid | Heating temperature (° C.) | Magnetic permeability | Core loss (kW/m$^3$) | Packing rate (vol %) |
|---|---|---|---|---|---|---|---|---|
| Embodiment | 1 | Silicon | none | none | 700 | 88 | 480 | 90 |
| | 2 | resin | ○ | none | | 90 | 515 | 89 |
| | 3 | | none | ○ | | 98 | 470 | 91 |
| | 4 | | ○ | ○ | | 95 | 450 | 90 |
| | 5 | | | | 500 | 82 | 620 | |
| | 6 | | | | 900 | 111 | 920 | |
| | 7 | PVB | ○ | none | 700 | 82 | 660 | 88 |
| | 8 | | ○ | ○ | | 90 | 710 | 90 |
| Comparison | 9 | Water glass | none | none | 700 | 60 | 2500 | 88 |
| | 10 | PVB | none | none | | 50 | 3200 | 89 |
| | 11 | Silicone | ○ | ○ | none | 45 | 2400 | 90 |
| | 12 | resin | | | 450 | 61 | 1500 | |
| | 13 | | | | 950 | 83 | 3000 | |

The granulated powder was put in a mold, and compressed by a uniaxial press at a pressure of 10 t/cm$^2$ for three seconds. As a result, a toroidal formed piece of 25 mm in outside diameter, 15 mm in inside diameter, and about 10 mm in thickness was obtained.

The obtained formed piece was put in a heat treatment oven, and heated in nitrogen atmosphere at a heat treatment temperature shown in Table 1. The holding time at the heat treatment temperature was 0.5 hour.

These samples were measured in the magnetic permeability, the core loss and the packing rate of alloy powder in a core. The results of these measurements are shown in Table 1. The magnetic permeability was measured by using an LCR meter at frequency of 10 kHz, and the core loss by an alternating current B-H curve measuring instrument at measuring frequency of 50 kHz, and measuring magnetic flux density of 0.1 T. The packing rate shown in the table is the value, (core density/real density of alloy powder)×100. Sample numbers 1 to 8 represent embodiments of the present invention, and sample numbers 9 to 13 are comparative examples.

The selection standard in the choke coil for, countermeasure against harmonic distortion is core loss of 1000 kW/m$^3$ or less, in the conditions of the current measuring frequency of 50 kHz and measuring magnetic flux density of 0.1 T. Magnetic permeability should be 60 or more.

As clear from the results shown in Table 1, the samples of number 1 to 8 satisfy the above selection standard. Especially, the samples number 1 to 6, which being the combination of Fe—Ni alloy powder and silicone resin binder, show excellent characteristics; namely, great magnetic permeability and small core loss. The thermal diffusion inhibitor is also seen to be effective; compare the samples number 7 and 10, a binder which by itself can not clear the core loss requirement satisfies the standard when it is combined with thermal diffusion inhibitor. The fatty acid contributes to increase packing rate of alloy powder in a core, and improves the magnetic permeability. The heat treatment of 500–900° C. applied on a compression-formed piece improves the magnetic permeability and the core loss.

The heat treatment should preferably be made in a non-oxidizing atmosphere of 500–900° C., more preferably within a temperature range 700–900° C. The higher the heat treatment temperature the more effective for reducing the hysteresis loss, in so far as the alloy powder does not start getting sintered.

In a compression-molded piece having a packing rate exceeding 88%, there exists a least pore (vacancy), and there is hardly any pore coming from the inside leading to the outside (open pore). When such a molded core piece undergoes a heat treatment, if a binder used in the piece had much evaporating content in it the evaporation can not take place sufficiently because of the small number of pores existing, as the result, the evaporated substance remains staying within the core. This leads to deteriorated characteristics. Therefore, a silicone resin, which keeps a high insulating capability up to a high temperature and contains only a small evaporating content, is suitable for use in a core piece of high packing rate.

For further enhancing the insulating capability with the magnetic alloy powder, it is effective to provide a thermal diffusion inhibitor on the surface of the alloy powder. Preferred material for the thermal diffusion inhibitor is a low molecular weight material having a high temperature insulating capability; practical example includes a silane monomer which can form a siloxane layer on the surface of alloy powder. During heat treatment applied to the compression-formed piece, such layer changes itself in part into silica, which provides a rigid insulation layer. The above thermal diffusion inhibitor leaves a room for the use, in a small quantity, of an ordinary organic binder, such as an epoxy, a polyvinyl acetal and the like. Thus a broader range is provided for the resin selection. In this way cores or other pieces of complex shape can now be provided through a compression-molding process. In the past, complicated pieces were not available through the compression-molding method.

The fatty acid plays a role of lubrication, which improves the mold separation, the plasticity of mixed substance and raises the packing rate of alloy powder in a compression-molded piece higher. Among the fatty acids, such metal fatty acids as zinc stearate, magnesium stearate and calcium stearate are significantly effective to increase the fluidity and the transmitting property of the granulated powder during molding process; which altogether leads to a higher packing rate. Use of the metal fatty acid contributes to insure a homogeneous compression, which property makes it suitable for the manufacture of compact and complex-shaped pieces by compression-molding. Such fatty acids as stearic acid and myristic acid, which evaporate at a relatively low temperature and hardly keep staying within a compression-formed piece after the heat treatment, are especially suitable to those pieces having a high packing rate of alloy powder.

Although an Fe—Ni alloy of 45% by weight of Ni is used in the present embodiment, other Fe—Ni alloys of different compositions may also be used depending on the field of application, in so far as the Ni content does not exceed approximately 90% by weight. Also, Fe—Ni alloys added with Cr, Mo or the like elements may be used instead.

Embodiment 2

To 100 parts by weight of the magnetic alloy powder of embodiment 1, 0.5 parts by weight of silicone resin and 3 parts by Weight of xylene as solvent were added and mixed together by using a mixing agitator. After the mixing was finished, it was dried to remove the solvent. The dried mixture was crushed, and granulated so that it flowed smoothly into a mold. Samples number 14 to 18 were prepared through the same way as in embodiment 1, except that packing rate of the alloy powder in a compression-formed piece was varied by changing the compression force of uniaxial press. The samples number 14 to 16 represent embodiments of the present invention; while the sample 17 and the sample 18, silicone resin content in the latter sample has been changed to 0.3 parts by weight, are examples for comparison.

Table 2 shows packing rate, magnetic permeability and core loss of these samples. Method of the measurement remains the same as in embodiment 1, so description of which method is not repeated here.

TABLE 2

| | Sample No. | Packing rate (vol %) | Magnetic permeability | Core loss (kW/m$^3$) |
|---|---|---|---|---|
| Embodiment | 14 | 88 | 65 | 590 |
| | 15 | 92 | 103 | 450 |
| | 16 | 95 | 125 | 420 |
| Comparison | 17 | 87 | 58 | 610 |
| | 18 | 96 | 130 | 1200 |

As clear from the results in Table 2, the samples well meet the above described selection standards when the packing rate falls within a range 88–95% by volume. Where, the higher the packing rate the better performance in both the magnetic permeability and the core loss. The sample whose packing rate is lower than 87% by volume can not satisfy the standard. A packing rate higher than 96% was not available with the samples having 0.5 parts by weight of silicone resin despite an increased compression force; therefore, the sample 18 was prepared with a reduced silicone content. Although the sample 18 attained an increased packing rate, it failed to insure the insulation between the alloy powder particles, and the core loss increased.

For providing favorable characteristics, it is preferred that the packing rate of alloy powder in a compression-formed piece falls within a range 88–95% in terms of volume. Within the range, the higher the packing rate the better the characteristics.

Embodiment 3

Samples number 19 to 24 were prepared through the same way as in the sample number 4 of embodiment 1, except that the mean particle diameter of magnetic alloy powder was varied. The samples were measured in the characteristic items. Samples number 19 to 22 represent embodiments of the present invention, while samples number 23 and 2 are for comparison. The packing rate of alloy powder is within a range 88–95% with all of the samples.

Table 3 shows the results of measurement.

TABLE 3

| | Sample No. | Mean particle diameter ($\mu$m) | Magnetic permeability | Core loss (kW/m$^3$) |
|---|---|---|---|---|
| Embodiment | 19 | 1 | 60 | 680 |
| | 20 | 10 | 63 | 280 |
| | 21 | 50 | 95 | 450 |
| | 22 | 100 | 125 | 880 |
| Comparison | 23 | 110 | 135 | 1350 |
| | 24 | 0.8 | 56 | 1430 |

As shown in Table 3, the above.describe selection standard is satisfied with the samples whose mean particle diameter of magnetic alloy powder is not smaller than 1 $\mu$m, not greater than 100 $\mu$m.

The eddy current loss increases in proportion to the square of frequency and the square of a flowing size of eddy current. The loss can be suppressed by covering the surface of magnetic particle with an insulating material. The eddy current is dependent on particle diameter of the magnetic powder; the finer the particle the smaller the eddy current loss. However, when particle diameter goes smaller the relative surface area of a particle normally increases. Accordingly, the size of eddy current increases and eddy current loss goes high, unless surface of the magnetic powder is covered enough with an insulating material.

With the choke coils for countermeasure against harmonic distortion, for example, the core loss should preferably be 1000 kW/m$^3$ or less, more preferably 500 kW/m$^3$ or less, in the conditions of the current measuring frequency of 50 kHz and measuring magnetic flux density of 0.1 T. In order to satisfy the above requirements and lower the$_1$ eddy current loss in the frequency band higher than 50 kHz, the mean particle diameter should preferably be not smaller than 1 $\mu$m not greater than 100 $\mu$m, more preferably not smaller than 10 $\mu$m not greater than 50 $\mu$m.

Embodiment 4

Fe—Ni alloy powder of 45% by weight of Ni and remainder of Fe was prepared as the magnetic alloy powder by atomizing method, mean particle size of which powder being 20 $\mu$m. Next, alumina (particle diameter 0.3$\mu$m), or an inorganic powder, silicone resin, or an organic silicon compound, (a methyl system silicone resin, having a remainder of approximately 70–80% by volume after heating), silane monomer and silicone oil were prepared as the insulating material. Acrylic resin (polymethacrylate), silicone resin (a methyl system silicone resin, having a remainder of approximately 70–80% by volume after heating), epoxy resin and water glass were prepared as the binder. Stearic acid was prepared as the fatty acid. These materials were used for making the samples number 25 through 43 of Table 4.

To 100 parts by weight of magnetic alloy powder, 0.5 parts by weight of the insulating material and 3 parts by weight of xylene as solvent were mixed together by using a mixing agitator. The mixture was dried; and then mixed with 1 part by weight of one of the respective binders of Table 4, and further 3 parts by weight of xylene as solvent to be mixed again by a mixing agitator. After the mixing was finished, it was dried to remove the solvent. The dried mixture was crushed, and granulated so that it flows smoothly into a mold. Those samples containing the fatty acid were made with the granulated powder by adding 0.1 part by weight of fatty acid, and mixing together by a cross rotary mixer.

The granulated powder was put in a mold, and compressed by a uniaxial press at a pressure of 10 t/cm$^2$ for three seconds. As a result, a toroidal formed piece of 25 mm in outside diameter, 15 mm in inside diameter, and about 10 mm in thickness was obtained.

The obtained formed piece was put in a heat treatment oven to be treated under the conditions as shown in Table 4. The heat treatment in oxidizing atmosphere was conducted at heat-up speed 1° C./min., holding time 0.5 hour. That in non-oxidizing atmosphere was conducted at heat-up speed 5° C./min., holding time 0.5 hour. The toroidal formed samples were thus prepared.

For the purpose of ascertaining whether the pieces of higher complexity can be formed, namely for the purpose of evaluating the compactibility, cores shaped in a letter "E" were also manufactured for the samples of Table 4, using a uniaxial press at a pressure of 10 t/cm$^2$ for three seconds. The E-shaped core has a square contour whose side is 12 mm long, and the thickness is 5 mm; the middle foot is shaped in a column of 4 mm in the diameter, the outer feet have a 1 mm width, the back has a 1 mm width.

The toroidal shape samples were used for measuring the magnetic permeability, the core loss and the packing rate of magnetic alloy powder in the core; while the E-shaped samples were inspected with respect to the finished conditions of the core piece. The results are shown in Table 4. The magnetic permeability was measured by using an LCR meter at frequency of 100 kHz, a direct-current magnetic field of 5000 A/m, and the core loss was measured by an alternating current B-H curve measuring instrument at measuring frequency of 300 kHz, measuring magnetic flux density of 0.1 T. The packing rate shown in the table is the value, (core density/real density of alloy powder)×100. With respect to the evaluation of compactibility, those which do not bear any defect in the appearance are marked with "O", while those bearing crack or other defect are marked with "x". Samples number 25 to 33 represent embodiments of the present invention, while samples number 34 to 43 are comparative examples.

The selection standard in the choke coil for countermeasure against harmonic distortion is the core loss of 4500 kW/m$^3$ or less, in the conditions of the current measuring frequency of 300 kHz and measuring magnetic flux density of 0.1 T; the magnetic permeability of 50 or more, in the conditions of the measuring frequency of 100 kHz and direct-current magnetic field of 5000 A/m.

TABLE 4

| | Sample No. | Insulating material | Binder | Fatty acid | Heating temp./ oxidizing (° C.) | Heating temp./ non-oxidizing (° C.) | Permeability | Core loss (kW/m$^3$) | Packing rate (vol %) | Compactibility |
|---|---|---|---|---|---|---|---|---|---|---|
| Embodiment | 25 | Silicon | Acrylic | ○ | none | 700 | 58 | 2900 | 89 | ○ |
| | 26 | resin | resin | | | 500 | 52 | 3100 | 89 | ○ |
| | 27 | | | | | 900 | 60 | 4300 | 89 | ○ |
| | 28 | | | | 250 | 700 | 57 | 3000 | 89 | ○ |
| | 29 | | | | 350 | | 58 | 3000 | 89 | |
| | 30 | | | none | none | | 53 | 3500 | 87 | ○ |
| | 31 | Silane monomer | | ○ | | | 59 | 4200 | 91 | ○ |
| | 32 | Silicone oil | | | | | 58 | 4200 | 90 | ○ |
| | 33 | Alumina | | | | | 50 | 4400 | 86 | ○ |
| Comparison | 34 | Silicone | Acrylic | ○ | none | none | 30 | 9000 | 89 | ○ |
| | 35 | resin | resin | | | 450 | 42 | 7200 | 89 | ○ |
| | 36 | | | | | 950 | 58 | 10300 | 89 | ○ |

TABLE 4-continued

| Sample No. | Insulating material | Binder | Fatty acid | Heating temp./ oxidizing (° C.) | Heating temp./ non-oxidizing (° C.) | Permeability | Core loss (kW/m$^3$) | Packing rate (vol %) | Compactibility |
|---|---|---|---|---|---|---|---|---|---|
| 37 | | | | 400 | 700 | 40 | 9500 | 89 | ○ |
| 38 | | Silicone resin | | none | | 51 | 3500 | 87 | X |
| 39 | | Epoxy resin | | | | 48 | 5500 | 84 | X |
| 40 | | Water | | | | 45 | 12500 | 85 | X |
| 41 | Water glass | glass | | | | 39 | 13100 | 84 | X |
| 42 | Alumina | Silicone resin | | | | 50 | 3800 | 85 | X |
| 43 | none | Acrylic resin | | | | 35 | 20000 | 88 | ○ |

As clear from the results in Table 4, the samples of numbers 25 to 33 satisfy the selection standard in both the magnetic permeability and the core loss. Those containing acrylic resin as the binder show an excellent compactibility in forming a core piece of complex shape. Use of an insulating material proved to be effective for improving the core loss; an organic silicon compound, among others, proved to be especially effective. The fatty acid contributes to increase the packing rate of alloy powder in a core piece, and improves the magnetic permeability.

The high plasticity of acrylic resin contribute keeping the shape of a compression-formed piece as it is. Therefore, it is suitable to the formation of a shape of high complexity. Acrylic resin is further advantageous in its high thermal decomposition property in the oxidizing and in the non-oxidizing atmospheres; it hardly leaves any ash behind.

The heat treatment in oxidizing atmosphere of 250–350° C. conducted on compression-formed pieces does not deteriorate the core characteristics. The heat treatment in non-oxidizing atmosphere of 500–900° C. improves the magnetic permeability and the core loss of the compression-formed pieces. This heat treatment should preferably be made within a temperature range 700–900° C. The higher the heat treatment temperature the more effective it is in reducing the hysteresis loss, in so far as the alloy powder does not start getting sintered.

In case where binder resin remains within a core after heat treatment as residual carbon, it deteriorates the magnetic characteristics. Therefore, it should be avoided. Acrylic resin has a superior thermal decomposition property, and leaves hardly any residual carbon after heat treatment in the non-oxidizing atmosphere; thus, favorable characteristics can be realized. While in the oxidizing atmosphere, acrylic resin decomposes in a temperature range not higher than 350° C.; therefore, the binder resin can be degreased without substantially oxidizing the alloy powder. By degreasing in the oxidizing atmosphere of 250–350° C. prior to the heat treatment in non-oxidizing atmosphere, good cores of complex shape can be manufactured without inviting deformation or crack during the heat treatment procedure.

An insulating material for enhancing the insulation between alloy powder particles should be such that can withstand the temperature of heat treatment applied with an aim of lowering the hysteresis loss. Inorganic example for the insulating material includes oxide particles (alumina, magnesia, silica, titania, etc.) and inorganic high polymer. Organic high polymer is also suitable to the insulating material, in so far as it is least reactive to the alloy powder during heat treatment and maintains insulating property at the heat treatment temperature. An organic silicon compound, among others, that covers the surface of alloy powder in the form of siloxane layer is preferred. Preferred organic silicon compound includes silicone resin, as silane monomer and silicone oil. Preferred properties the organic silicon compound should preferably have are; that it readily covers the surface of the alloy powder and that it exhibits a small heating loss. The layer thus formed changes in part into silica during the heat treatment applied on compression-formed pieces, making itself a rigid insulation layer.

The fatty acid plays a role of lubrication, which improves the mold separation, the plasticity of the mixed substance and the packing rate of alloy powder higher. Among the fatty acids, such metallic fatty acids as zinc stearate, magnesium stearate and calcium stearate, for example, are significantly effective to increase the fluidity of granulated powder and the transmission of compression force during compression process, which improvement factors lead to a higher packing rate of alloy powder in a compression-formed piece. Metallic fatty acid contributes to insure the homogeneous compression and homogeneous formation of a compression-formed piece; therefore it is especially suitable for the formation of a small piece of complex shape. Such fatty acids as stearic acid and myristic acid evaporate at a relatively low temperature and rarely stay within a compression-formed piece after the heat treatment; therefore, these are especially suitable to those pieces of high alloy powder packing rate.

Embodiment 5

Samples number 44 to 48 were prepared through the same way as in the sample 25 of embodiment 4, except that the packing rate of the magnetic alloy powder in a compression-formed piece was varied by changing the compression force of uniaxial press. The samples number 44 to 46 represent embodiments of the present invention; while the sample number 47 and the sample 48, the silicone resin content in the latter sample has been changed to 0.3 parts by weight, are examples for comparison.

TABLE 5

| | Sample No. | Packing rate (vol %) | Magnetic permeability | Core loss (kW/m$^3$) |
|---|---|---|---|---|
| Embodiment | 44 | 85 | 51 | 3300 |
| | 45 | 89 | 58 | 2900 |
| | 46 | 95 | 62 | 3300 |
| Comparison | 47 | 84 | 49 | 3400 |
| | 48 | 96 | 62 | 4700 |

Table 5 shows the packing rate, the magnetic permeability and the core loss of these samples. Method of the measurement remains the same as in embodiment 4, so description of which method is not repeated here.

As clear from the results in Table 5, the samples of number 44 to 46 satisfy the selection standard for a choke coil described in embodiment 4 in both of the characteristic items, the magnetic permeability and the core loss. The magnetic permeability improves along with the increasing packing rate of alloy powder. If the packing rate is lower than 84%, it can not satisfy the selection standard in magnetic permeability. The sample 48 having a packing rate 96%, which has been prepared with a reduced silicone resin content because the addition of 1 part by weight of acrylic resin makes it impossible to attain the targeted packing rate 96% despite a high compression force, can not satisfy the standard due to increased core loss caused by the failure in securing rigid insulation between the alloy powder particles.

As described in the above, the packing rate of alloy powder should preferably be falling within a range 85–95% in terms of volume for a compression-formed piece of composite magnetic material to exhibit superior characteristics. In so far as it stays within the above-described range, the higher the packing rate the higher the performance.

Embodiment 6

Samples number 49 to 54 were prepared through the same way as in the sample 25 of embodiment 4, except that the mean particle diameter of the magnetic alloy powder was varied. The samples number 49 to 52 represent embodiments of the present invention; while the samples number 53 and 54 are examples for comparison. The packing rate of alloy powder fell within the range 85–95% with all of the samples.

Table 6 shows the results of measurement.

TABLE 6

| | Sample No. | Mean particle diameter ($\mu$m) | Magnetic permeability | Core loss (kW/m$^3$) |
|---|---|---|---|---|
| Embodiment | 49 | 1 | 50 | 3800 |
| | 50 | 10 | 55 | 2600 |
| | 51 | 20 | 95 | 2900 |
| | 52 | 50 | 125 | 4300 |
| Comparison | 53 | 60 | 135 | 5000 |
| | 54 | 0.7 | 43 | 6500 |

As clear from the results shown in Table 6, those samples whose mean particle diameter of the magnetic alloy powder is not smaller than 1 $\mu$m not greater than 50 $\mu$m satisfy the standard for the choke coil described earlier in embodiment 4.

Since the eddy current loss increases in proportion to the square of frequency and the square of a flowing size of eddy current, it can be suppressed by covering the surface of the magnetic particle with an insulating material. The eddy current is dependent on particle diameter of the magnetic powder; the finer the particle the smaller the eddy current loss.

However, when the particle diameter goes smaller the relative surface area of a particle normally increases. Accordingly, the size of eddy current increases and eddy current loss goes high unless surface of the magnetic powder is covered enough with an insulating material. With the choke coils for countermeasure against harmonic distortion, for example, the core loss should preferably be 4500 kW/m$^3$ or less, more preferably 3500 kW/m$^3$ or less, in the conditions of the current measuring frequency of 300 kHz and measuring magnetic flux density of 0.1 T. In order to reduce the eddy current loss at a frequency higher than 300 kHz, it is preferred that the mean particle diameter of the magnetic alloy powder is not smaller than 1 $\mu$m not greater than 50 $\mu$m, more preferably not smaller than 10 $\mu$m not greater than 20 $\mu$m.

Embodiment 7

Pure iron powder as well as Fe—Si alloy powders of 3.5% by weight of Si, 6.8% by weight of Si, 7.5% by weight of Si, 7.7% by weight of Si, respectively, and remainder of Fe were prepared as the magnetic powders by atomizing method. Mean particle diameter of the powder is 30 $\mu$m. Next, silicone resin (a methyl system silicone resin, having a remainder of approximately 70–80% by volume after heating) was prepared as the insulating material, acrylic resin (polymethacrylate), silicone resin (a methyl system silicone resin, having a remainder of approximately 70–80% by volume after heating), epoxy resin and water glass were prepared as the binder, and stearic acid was prepared as the fatty acid. These materials were used for making the samples number 55 to 86 of Table 7.

To 100 parts by weight of magnetic powder, 0.45 parts by weight of the insulating material was added and 4 parts by weight of xylene was added as solvent: these were mixed by using a mixing agitator. The mixture was dried; and then further provided with one of the respective binders for 0.9 parts by weight as shown in Table 7, further 4 parts by weight of xylene was added as solvent. These were mixed again by a mixing agitator. After the mixing was finished, it was dried to remove the solvent. The dried mixture was crushed, and granulated so that it flowed smoothly into a mold. Those samples containing the fatty acid were made with the above granulated powder by adding 0.15 part by weight of fatty acid and mixing these together using a cross rotary mixer.

The granulated powder was put in a mold, and compressed by a uniaxial press at a pressure of 12 t/cm$^2$ for three seconds. As a result, a toroidal formed piece of 25 mm in outside diameter, 15 mm in inside diameter, and about 10 mm in thickness was obtained.

The obtained formed piece was put in a heat treatment oven to be treated under the respective conditions as shown in Table 7. The heat treatment in oxidizing atmosphere was conducted at the heat-up speed 1° C./min., holding time 0.5 hour. That in non-oxidizing atmosphere was conducted at the heat-up speed 5° C./min., holding time 0.5 hour. In this way, the toroidal sample pieces were prepared.

For the purpose of ascertaining whether pieces of more complicated shapes can be formed, namely for evaluating the compactibility, cores shaped in a letter "E" were also manufactured for the samples of Table 7, using a uniaxial press at a pressure of 12 t/cm$^2$ for three seconds. The E-shaped core has a square contour having a side of 12 mm long and thickness of 5 mm; the middle foot is shaped in a column of 4 mm diameter, the outer feet have a width of 1 mm, the back has a width of 1 mm.

The toroidal shape samples were used for measuring the magnetic permeability, the core loss and the packing rate of magnetic powder in the core piece, while the E-shaped samples were inspected with respect to the finished conditions of the core piece. The results are shown in Table 7. The magnetic permeability was measured by using an LCR meter at frequency

TABLE 7

| | Sample No. | Metal particle | Insulating material | Binder | Fatty acid | Heating temp./ oxidizing (° C.) | Heating temp./ non-oxidizing (° C.) | Permeability | Core loss (kW/m$^3$) | Packing rate (vol %) | Compactibility |
|---|---|---|---|---|---|---|---|---|---|---|---|
| Embodiment | 55 | Fe | Silicon | Acrylic | ○ | none | 750 | 66 | 820 | 87 | ○ |
| | 56 | | resin | resin | | | 500 | 60 | 880 | 87 | ○ |
| | 57 | | | | | | 900 | 67 | 800 | 88 | ○ |
| | 58 | | | | | 250 | 750 | 63 | 860 | 87 | ○ |
| | 59 | | | | | 350 | | 62 | 860 | 87 | ○ |
| | 60 | | | | none | none | | 60 | 830 | 86 | ○ |
| | 61 | Fe—3.5Si | Silicone | Acrylic | ○ | none | 830 | 65 | 770 | 88 | ○ |
| | 62 | | resin | resin | | | 500 | 61 | 890 | 85 | ○ |
| | 63 | | | | | | 900 | 67 | 720 | 89 | ○ |
| | 64 | | | | | 250 | 830 | 64 | 800 | 88 | ○ |
| | 65 | | | | | 350 | | 63 | 810 | 88 | ○ |
| | 66 | | | | none | none | | 63 | 750 | 87 | ○ |
| | 67 | Fe—6.8Si | Silicone | Acrylic | ○ | none | | 61 | 570 | 86 | ○ |
| | 68 | Fe—7.5Si | resin | resin | | | | 60 | 610 | 85 | ○ |

of 10 kHz, a direct-current magnetic field of 5000 A/m, and the core loss was measured by an alternating current B-H curve measuring instrument at measuring frequency of 50 kHz, measuring magnetic flux density of 0.1 T. The packing rate shown in the table is the value, (core density/real density of powder)×100. With respect to the compactibility evaluation, those which do not bear any defect in the appearance are marked with "O", while those having crack or other defect are marked with "x". Samples number 55 to 68 represent embodiments of the present invention, and samples number 69 to 86 are comparative examples.

The selection standard in the choke coil for countermeasure against harmonic distortion is the core loss of 1000 kW/m$^3$ or less, in the conditions of current measuring frequency of 50 kHz and measuring magnetic flux density of 0.1 T, and the magnetic permeability needs to be 60 or more.

As clear from the results in Table 7, the samples number 55 to 68 satisfy the selection standard in both of the characteristic items, the magnetic permeability and the core loss. Those samples in which acrylic resin was used as the binder show an excellent compactibility in forming a core of complex shape. Use of an organic silicon compound proved to be effective for improving the core loss. The fatty acid contributes to increase the packing rate of powder in a core piece, and improves the magnetic permeability.

It is observed that the heat treatment in oxidizing atmosphere of 250–350° C. does not deteriorate the core characteristics of the compression-formed pieces, and that the heat treatment in non-oxidizing atmosphere of 500–900° C. improves the magnetic permeability and the core loss.

Further, it is observed that the pure iron Or Fe—Si alloy powder containing Si for≦7.5% by weight (0% not included) and remainder of Fe exhibits excellent characteristics with a high magnetic permeability and a low core loss.

The high plasticity of acrylic resin contributes to maintain the shape of a compression-formed piece as it is. Therefore it is suitable to the formation of high complexity pieces. Acrylic resin is further advantageous in its high thermal decomposition property in the oxidizing and in the non-oxidizing atmospheres; it hardly leaves any ash behind.

The preferred temperature of heat treatment is 500–900° C. in non-oxidizing atmosphere, more preferably 700–900° C. The higher the heat treatment temperature the more effective it is for the reduction of hysteresis loss, in so far as the magnetic powder does not start getting sintered. If binder resin leaves any residual carbon in a core piece after the heat treatment, it deteriorates the magnetic characteristics. Acrylic resin has a superior thermal decomposition property, and leaves hardly any residual carbon after the heat treatment in non-oxidizing atmosphere. Thus, favorable characteristics can be realized. While in the oxidizing atmosphere, acrylic resin decomposes in a temperature range not higher than 350° C.; therefore, the binder resin can be degreased without much oxidizing the magnetic powder. Therefore, also in forming a core piece of complex shape, it is preferred that it is degreased in oxidizing atmosphere of 250–350° C. prior to heat treatment in non-oxidizing atmosphere. By so doing, good core pieces can be provided without inviting deformation or crack during the heat treatment.

An insulating material for enhancing the insulation between the powder particles should be such that can withstand the temperature of the earlier described heat treatment process applied for lowering the hysteresis loss. Inorganic example for the insulating material includes oxide particles (alumina, magnesia, silica, titania, etc.) and inorganic high polymer. Organic silicon compound can also be used for the purpose. Other insulating materials can also be used, in so far as it is least reactive to the powder during heat treatment, and maintains the insulating property at the temperature during heat treatment procedure. More preference is on an organic silicon compound, which covers the surface of powder particle in the form of a siloxane layer. Among the organic silicon compounds silicone resin, silane monomer, silicone oil, etc. are suitable to the purpose. These which have a property readily covering the powder surface and exhibit a small heating loss are preferred. The layer thus formed changes in part into silica during the heat treatment applied on compression-formed pieces, making itself a rigid insulation layer.

The fatty acid plays a role of lubrication, which improves the mold separation, the plasticity of the mixed substance and the packing rate of the powder higher. Among the fatty acids, such metallic fatty acids as zinc stearate, magnesium stearate and calcium stearate are significantly effective to increase the fluidity of granulated powder and transmission of force during compression process, which properties leading to a higher packing rate of the powder in a compression-formed piece. Metallic fatty acid contributes to insure the homogeneous compression and homogeneous formation of a compression piece; therefore, it is suitable for manufacturing a small piece of complex shape. Such fatty acids as stearic acid and myristic acid, which evaporate at a relatively low temperature and hardly stay behind within a compression-formed piece after heat treatment, are especially suitable to those pieces of high packing rate.

Embodiment 8

Samples number 87 to 91 were prepared through the same way as in the sample 55 of embodiment 7, except that the packing rate of the powder in a compression-formed piece was varied by changing the compression force of uniaxial press. The samples number 87 to 89 represent embodiments of the present invention; while the sample 90 and the sample 91, the silicone resin content in the latter sample has been changed to 0.3 parts by weight, are examples for comparison.

Table 8 shows the packing rate, the magnetic permeability and the core loss of these samples. Method of the measurement remains the same as in embodiment 7, so the description of which method is not repeated here.

As clear from the results in Table 8, the samples number 87 to 89 satisfy the selection standard for a choke coil described in embodiment 7 in both of the characteristics, the magnetic permeability and the core loss. The magnetic permeability improves along with the increasing packing rate of the powder. If the packing rate is lower than 84%, it can not satisfy the selection standard in magnetic permeability. The sample 91 having a packing rate 96%, which has been prepared with reduced silicone resin content because the addition of 0.9 parts by weight of the acrylic resin makes it impossible to attain the targeted packing rate 96% despite high compression, can not satisfy the standard due to the increased core loss caused by failure of securing rigid insulation between the powder particles.

TABLE 8

| | Sample No. | Composition | Packing rate (vol %) | Magnetic permeability | Core loss (kW/m$^3$) |
|---|---|---|---|---|---|
| Embodiment | 87 | Fe | 85 | 51 | 850 |
| | 88 | | 88 | 66 | 800 |
| | 89 | | 95 | 68 | 870 |
| Comparison | 90 | | 84 | 58 | 920 |
| | 91 | | 96 | 68 | 1400 |

As described in the above, the packing rate of the powder should preferably be falling within a range 85–95% in terms of volume, in order to provide a compression-formed piece with superior characteristics as the composite magnetic material. In so far as it stays within the range, the higher the packing rate the higher the performance.

Further, in a case where a Fe—Si alloy powder containing Si for≦7.5% by weight and remainder of Fe is used, it exhibits excellent characteristics with a high magnetic permeability and a low core loss, in, so far as the packing rate of the alloy powder in a compression-formed piece falls within the range 85–95% in terms of volume.

Embodiment 9

Samples number 92 to 97 were prepared through the same way as in the sample 55 of embodiment 7, and samples 98 to 103 were prepared through the same way as in the sample 61 of embodiment 7, except that the mean particle diameters of Fe powder and Fe—Si alloy powder were varied. These samples underwent the measurement of characteristics. The samples number 92 to 95, and those number 98 to 101 represent embodiments of the present invention; while the samples number 96, 97, 102 and 103 are examples for comparison. The packing rate of the magnetic powder fell within the range 85–95% with all of the samples.

Table 9 shows the results of measurement.

TABLE 9

| | Sample No. | Composition | Mean particle diameter | Magnetic permeability | Core loss (kW/m$^3$) |
|---|---|---|---|---|---|
| Embodiment | 92 | Fe | 1 | 61 | 880 |
| | 93 | | 10 | 63 | 790 |
| | 94 | | 30 | 66 | 820 |
| | 95 | | 50 | 69 | 980 |
| Comparison | 96 | | 0.9 | 58 | 1300 |
| | 97 | | 65 | 70 | 2000 |
| Embodiment | 98 | Fe—3.5Si | 1 | 60 | 850 |
| | 99 | | 10 | 61 | 740 |
| | 100 | | 30 | 64 | 770 |
| | 101 | | 50 | 67 | 930 |
| Comparison | 102 | | 0.8 | 67 | 1150 |
| | 103 | | 60 | 58 | 1700 |

As clear from the results shown in Table 9, those samples whose mean particle diameter of the magnetic powder is not smaller than 1 $\mu$m not greater than 50 $\mu$m satisfy the standard for a choke coil described earlier in embodiment 7.

Since the eddy current loss increases in proportion to the square of frequency and the square of a flowing size of eddy current, it can be suppressed by covering the surface of magnetic particle with an insulating material. The eddy current,is dependent on particle diameter of the magnetic powder; the finer the particle the smaller the eddy current loss. With the choke coils for countermeasure against harmonic distortion, for example, the core loss is preferred to be 1000 kW/m$^3$ or less, in the conditions of the current measuring frequency of 50 kHz and measuring magnetic flux density of 0.1 T. In order to reduce the eddy current loss at a frequency higher than 50 kHz, it is preferred that the mean particle diameter of the magnetic powder is not smaller than 1 $\mu$m not greater than 50 $\mu$m.

Further, in a case where a Fe—Si alloy powder containing Si for ≦7.5% by weight and remainder of Fe is used, it exhibits excellent characteristics with a high magnetic permeability and a low core loss, in so far as the mean particle diameter of the alloy powder falls within a range not smaller than 1 $\mu$m not greater than 50 $\mu$m.

Industrial Applicability

The present invention offers a composite magnetic body that exhibits a small core loss and a high magnetic permeability even when it is used in a high frequency band region. The composite magnetic body may be formed in various compression-formed core pieces of complex shapes.

What is claimed is:

1. A composite magnetic body of a compressed compact comprising a mixture of a magnetic alloy powder containing iron and nickel as main components, a binder of a silicone resin for binding the magnetic alloy powder together, and a thermal diffusion inhibitor including a silane monomer.

2. The composite magnetic body of claim 1, wherein the compressed compact contains a fatty acid.

3. The composite magnetic body of claim 1, wherein a packing rate of the magnetic alloy powder in the compressed compact falls within a range of 88–95% by volume.

4. The composite magnetic body of claim 1, wherein a mean particle diameter of the magnetic alloy powder falls within a range of 1–100 $\mu$m.

5. A composite magnetic body of a compressed compact comprising a mixture of a magnetic alloy containing iron and nickel as main components, an insulating material and a binder of an acrylic resin for binding these together, said insulating material selected from the group consisting of oxide particles and organic silicon compound, wherein said organic silicon compound includes at least one of silicone resin and silicone oil.

6. The composite magnetic body of claim 5, wherein the compressed compact contains a fatty acid.

7. The composite magnetic body of claim 5, wherein a packing rate of the magnetic alloy powder in the compressed compact falls within a range of 85–95% by volume.

8. The composite magnetic body of claim 5, wherein a mean particle diameter of the magnetic alloy powder falls within a range of 1–50 $\mu$m.

9. The composite magnetic body of claim 5, wherein said oxide particles includes at least one of alumina, magnesia, silica, and titania.

10. The composite magnetic body of claim 5, wherein said organic silicone compound includes silane monomer.

11. A composite magnetic body of a compressed compact comprising a mixture of a magnetic iron powder or a magnetic alloy powder comprising 7.5% by weight or less (0% is not included) of silicon and remainder of iron, an insulating material and a binder of an acrylic resin for binding these together, said insulating material selected from the group consisting of oxide particles and organic silicon compound, wherein said organic silicon compound includes at least one of silicone resin and silicone oil.

12. The composite magnetic body of claim 11, wherein the compressed compact contains a fatty acid.

13. The composite magnetic body of claim 11, wherein a packing rate of the magnetic powder in the compressed compact falls within a range of 85–95% by volume.

14. The composite magnetic body of claim 11, wherein a mean particle diameter of the magnetic powder falls within a range of 1–50 $\mu$m.

15. The composite magnetic body of claim 11, wherein said oxide particles includes at least one of alumina, magnesia, silica and titania.

16. The composite magnetic body of claim 11, wherein said organic silicon compound includes silane monomer.

17. A method for manufacturing a composite magnetic body comprising the steps of:

mixing a magnetic alloy powder, an insulating material, and an acrylic resin into a mixture, granulating the mixture into a granulated powder, compressing the granulated powder into a magnetic core, heating the magnetic core at a temperature between 250 and 350° C., and heating the magnetic core at a temperature between 500 and 900° C. in a non-oxidizing atmosphere.

18. The method for manufacturing a composite magnetic body of claim 17, wherein the step of heating the magnetic core at a temperature between 250 and 350° C. is performed before the step of heating the magnetic cot at a temperature between 500 and 900° C. in a non-oxidizing atmosphere.

19. A composite magnetic body of a compressed compact comprising a mixture of a magnetic alloy powder containing iron and nickel as main components, and a binder of a silicone resin for binding the magnetic alloy powder together, wherein a packing rate of the magnetic alloy powder in the compressed compact falls within a range of 88–95% by volume.

20. The composite magnetic body of claim 19, wherein the mixture further contains a thermal diffusion inhibitor.

21. A composite magnetic body of a compressed compact comprising a mixture of a magnetic alloy containing iron and nickel as main components, an insulating material and a binder of an acrylic resin for binding these together, wherein the compressed compact contains a fatty acid.

22. The composite magnetic body of claim 21, wherein said insulating material is selected from the group consisting of oxide particles and organic silicon compound.

23. A composite magnetic body of a compressed compact comprising a mixture of a magnetic alloy containing iron and nickel as main components, an insulating material and a binder of an acrylic resin for binding these together, said insulating material including oxide particles.

24. The composite magnetic body of claim 23, wherein said oxide particles includes at least one of alumina, magnesia, silica, and titania.

25. A composite magnetic body of a compressed compact comprising a mixture of a magnetic alloy containing iron and nickel as main components, an insulating material and a binder of an acrylic resin for binding these together, wherein a packing rate of the magnetic alloy in the compressed compact falls within a range of 85–95% by volume.

26. The composite magnetic body of claim 25, wherein said insulating material is selected from the group consisting of oxide particles and organic silicon compound.

27. A composite magnetic body of a compressed compact comprising a mixture of a magnetic iron powder or a magnetic alloy powder comprising 7.5% by weight or less (0% is not included) of silicon and remainder of iron, an insulating material and a binder of an acrylic resin for binding these together, wherein the compressed compact contains a fatty acid.

28. The composite magnetic body of claim 27, wherein said insulating material is selected from the group consisting of oxide particles and organic silicon compound.

29. A composite magnetic body of a compressed compact comprising a mixture of a magnetic iron powder or a magnetic alloy powder comprising 7.5% by weight or less (0% is not included) of silicon aid remainder of iron, an insulating material and a binder of all acrylic resin for binding these together, wherein a packing rate of the magnetic powder in the compressed compact falls within a range of 85–95% by volume.

30. The composite magnetic body of claim 29, wherein said insulating material is selected from the group consisting of oxide particles and organic silicon compound.

31. A composite magnetic body of a compressed compact comprising a mixture of a magnetic iron powder or a magnetic alloy powder comprising 7.5% by weight or less (0% is not included) of silicon and remainder of iron, an insulating material and a binder of an acrylic resin for binding these together, said insulating material including oxide particles.

32. The composite magnetic body of claim 31, wherein said oxide particles includes at least one of alumina, magnesia, silica, and titania.

* * * * *